US010167578B2

(12) United States Patent
Honeycutt et al.

(10) Patent No.: US 10,167,578 B2
(45) Date of Patent: Jan. 1, 2019

(54) METHODS AND SYSTEMS FOR REGULATING TENSION IN WARPING

(71) Applicant: COLUMBIA INSURANCE COMPANY, Omaha, NE (US)

(72) Inventors: Mark Avery Honeycutt, Cartersville, GA (US); Keith Goble, Cartersville, GA (US)

(73) Assignee: COLUMBIA INSURANCE COMPANY, Omaha, NE (US)

( * ) Notice: Subject to any disclaimer, the term of this patent is extended or adjusted under 35 U.S.C. 154(b) by 0 days.

(21) Appl. No.: 15/599,156

(22) Filed: May 18, 2017

(65) Prior Publication Data

US 2017/0254001 A1 Sep. 7, 2017

Related U.S. Application Data

(63) Continuation of application No. 13/830,745, filed on Mar. 14, 2013, now Pat. No. 9,833,316.

(60) Provisional application No. 61/624,057, filed on Apr. 13, 2012.

(51) Int. Cl.

| | |
|---|---|
| ***D01H 13/26*** | (2006.01) |
| ***D02H 13/26*** | (2006.01) |
| ***D02H 3/00*** | (2006.01) |
| ***D02H 5/00*** | (2006.01) |

(52) U.S. Cl.

CPC ..... *D02H 13/26* (2013.01); *D02H 3/00* (2013.01); *D02H 5/00* (2013.01)

(58) Field of Classification Search

CPC D02H 3/00; D02H 5/00; D02H 13/00; D02H 13/22; D02H 13/26; D03D 49/16

USPC ..... 28/190, 191, 194, 196, 197, 199

See application file for complete search history.

(56) References Cited

U.S. PATENT DOCUMENTS

| | | | | | |
|---|---|---|---|---|---|
| 951,888 | A * | 3/1910 | Rhoades | D02H 3/00 | 139/103 |
| 1,140,460 | A * | 5/1915 | Jaeger | 226/195 | |
| 1,439,331 | A * | 12/1922 | Schofield | D02H 3/00 | 139/1 C |
| 1,818,526 | A * | 8/1931 | Baker | D02H 13/00 | 28/194 |
| 1,935,242 | A * | 11/1933 | Fulton | D02H 1/00 | 28/190 |
| 1,948,646 | A * | 2/1934 | Bruenn | D06B 3/04 | 139/428 |
| 1,988,918 | A * | 1/1935 | Reiners | D02H 13/16 | 28/195 |
| 2,537,007 | A * | 1/1951 | Abbott, Jr. | D03J 1/16 | 156/158 |
| 2,542,097 | A * | 2/1951 | Shaffer | B65H 63/0321 | 242/131.1 |

(Continued)

*Primary Examiner* — Richale Quinn
*Assistant Examiner* — Anne Kozak
(74) *Attorney, Agent, or Firm* — Ballard Spahr LLP

(57) ABSTRACT

A warping system for reducing tension in a plurality of yarn ends wound by the warping system onto a beam. The warping system minimizes the number of contact points as yarn is pulled off of yarn packages in a creel and wound onto the beam. After exiting a tube, yarn passes over a roller and an expansion comb before being wound onto the beam. The yarn extends between the roller and the beam substantially in a yarn plane. The yarn can contact the warping system at only one contact point between the roller and the beam.

17 Claims, 4 Drawing Sheets

(56) References Cited

U.S. PATENT DOCUMENTS

| | | | | | |
|---|---|---|---|---|---|
| 2,558,033 | A * | 6/1951 | Bauer | D02H 3/00 | 28/194 |
| 3,648,338 | A * | 3/1972 | Mruk | D02H 13/00 | 242/155 R |
| 3,966,133 | A * | 6/1976 | Gelin | B65H 59/30 | 242/154 |
| 4,819,310 | A * | 4/1989 | Beerli | D02H 13/14 | 28/185 |
| 4,941,240 | A * | 7/1990 | Denzler | D02H 3/00 | 28/187 |
| 4,944,077 | A * | 7/1990 | Bollen | B65H 54/702 | 15/312.1 |
| 5,022,128 | A * | 6/1991 | Beerli | D02H 9/00 | 28/191 |
| 5,588,194 | A * | 12/1996 | Ulbrich | D02H 13/02 | 28/190 |
| 5,613,643 | A * | 3/1997 | Weiner | B65H 57/12 | 112/163 |
| 5,628,098 | A * | 5/1997 | Beerli | D02H 9/00 | 28/191 |
| 6,126,102 | A * | 10/2000 | Mycielski | B65H 49/02 | 242/128 |
| 6,511,011 | B2 * | 1/2003 | Zeller | D02H 13/24 | 242/131.1 |
| 7,770,271 | B2 * | 8/2010 | Kleiner | D02H 13/24 | 28/185 |
| 2002/0042975 | A1 * | 4/2002 | Spring | D02H 9/00 | 28/190 |
| 2006/0277729 | A1 * | 12/2006 | Colson | D02H 1/00 | 28/190 |

* cited by examiner

METHODS AND SYSTEMS FOR REGULATING TENSION IN WARPING

CROSS REFERENCE TO RELATED APPLICATIONS

This application is a continuation of co-pending U.S. patent application Ser. No. 13/830,745, filed Mar. 14, 2013, which claims priority to and the benefit of the filing date of U.S. Provisional Patent Application 61/624,057, filed Apr. 13, 2012, which applications are incorporated herein by reference in their entirety.

BACKGROUND OF THE INVENTION

The invention relates in general to the winding of yarn onto beams. More particularly, the invention relates to methods and systems for regulating and/or reducing the tension of yarn as it is wound onto a beam.

FIELD OF THE INVENTION

A warping machine ("warper") is configured to systematically arrange a number of yarns drawn onto a warping beam or drum. With conventional warping systems, yarn is pulled from a plurality of packages mounted to a creel. Prior to winding onto the beam, the yarn is drawn through a number of devices to attempt to evenly feed the yarn to the beam. For example, with conventional warping systems, yarn is threaded from the creel through tubes, drop wires, tight end detectors and guides to the warper. As can be appreciated, when the yarn sequentially contacts these devices, tension can be sequentially added or otherwise transferred to the yarn. Adding tension to yarn in the process of the yarn being drawn onto the warping beam or drum can be undesirable as over-tensioned yarn can cause downstream manufacturing difficulties that can result in below standard carpet products.

Conventional warpers have an expansion comb for spreading the yarn to a desired width to fit evenly on the beam. As the distance between the expansion comb and adjacent rollers is typically relatively small, the angle at which each yarn end is pulled can be relatively large, thereby dramatically and undesirably increasing the tension being applied to the respective yarns. Also, because yarn ends towards the outer edges of the yarn comb are redirected by the expansion comb through much larger angles than yarn ends towards the center of the yarn comb, applied tension can vary greatly among different yarns wound onto the same beam.

Thus, there remains a need for warping systems that reduce tension of yarn wound onto beams. Further, there is a need for regulating tension across the yarn ends of the beam so that each end is wound onto the beam at substantially the same tension.

SUMMARY OF THE INVENTION

The present invention is generally directed to a warping system for reducing tension in a plurality of yarn ends wound by the warping system onto a beam. The warping system is configured to minimize the number of contact points (which create tension in the yarn) as yarn is pulled off of yarn packages in a creel and wound onto the beam. In one aspect, the system comprises a warper that is conventionally configured to rotate the beam. As one skilled in the art will appreciate, upon threading of yarn through the system, the rotation of the beam will pull yarn off of the packages, through the system and eventually onto the beam.

In one aspect, the system further comprises a roller positioned above at least a portion of the warper and an expansion comb positioned between the roller and the warper. The roller can be configured to redirect yarn supplied from the creel towards the warper, and the expansion comb can be configured to position each yarn end in a predetermined position relative to the other yarns ends. Thus, according to another aspect, yarn traveling over the roller can be wound onto the beam after contacting the warping system at only one other contact point (the expansion comb).

A yarn plane can be defined between a circumferential edge of the roller and an outer diameter of wound yarn on a beam positioned in the warper. In one aspect, when the warping system is in use, yarn extending from the roller to the outer diameter of wound yarn on the beam can be positioned substantially in the yarn plane. Thus, when the system is viewed in a side elevational view, the yarn can extend from the roller, through the expansion comb and to the beam substantially linearly. In another aspect, the yarn plane can be positioned at an angle of about 90 degrees relative to the floor on which the warper sits.

In one aspect, the system can further comprise a plurality of tubes extending from the creel to a position above at least a portion of the warper and/or beam positioned in the warper. Each tube has a lumen extending therethrough that is sized and shaped to allow for the free passage of one yarn.

The system can further comprise at least one end-out detection device. In one aspect, the at least one end-out device can be positioned near the creel. In various optional aspects, the end-out detection device can be a non-contact sensor, or a low or no friction detection sensor such as a conventional optical sensor that is configured to sensor or otherwise identify broken yarn ends without physically contacting the yarn.

One skilled in the art will appreciate that a reduction in tension in yarn being processed through the warping system can allow for faster processing times without leading to extra broken yarn ends. For example, the warping system of the current application can be operated at higher speeds than conventional warpers while still maintaining a lower yarn tension. Thus, a method for increasing the processing speed of a warping system is also provided herein.

BRIEF DESCRIPTION OF THE DRAWINGS

The accompanying drawings, which are incorporated in and constitute a part of this specification, illustrate several aspects described below and together with the description, serve to explain the principles of the invention. Like numbers represent the same elements throughout the figures.

DETAILED DESCRIPTION OF THE INVENTION

The present invention can be understood more readily by reference to the following detailed description, examples, drawing, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a guide" can include two or more such guides unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

Figure 1:
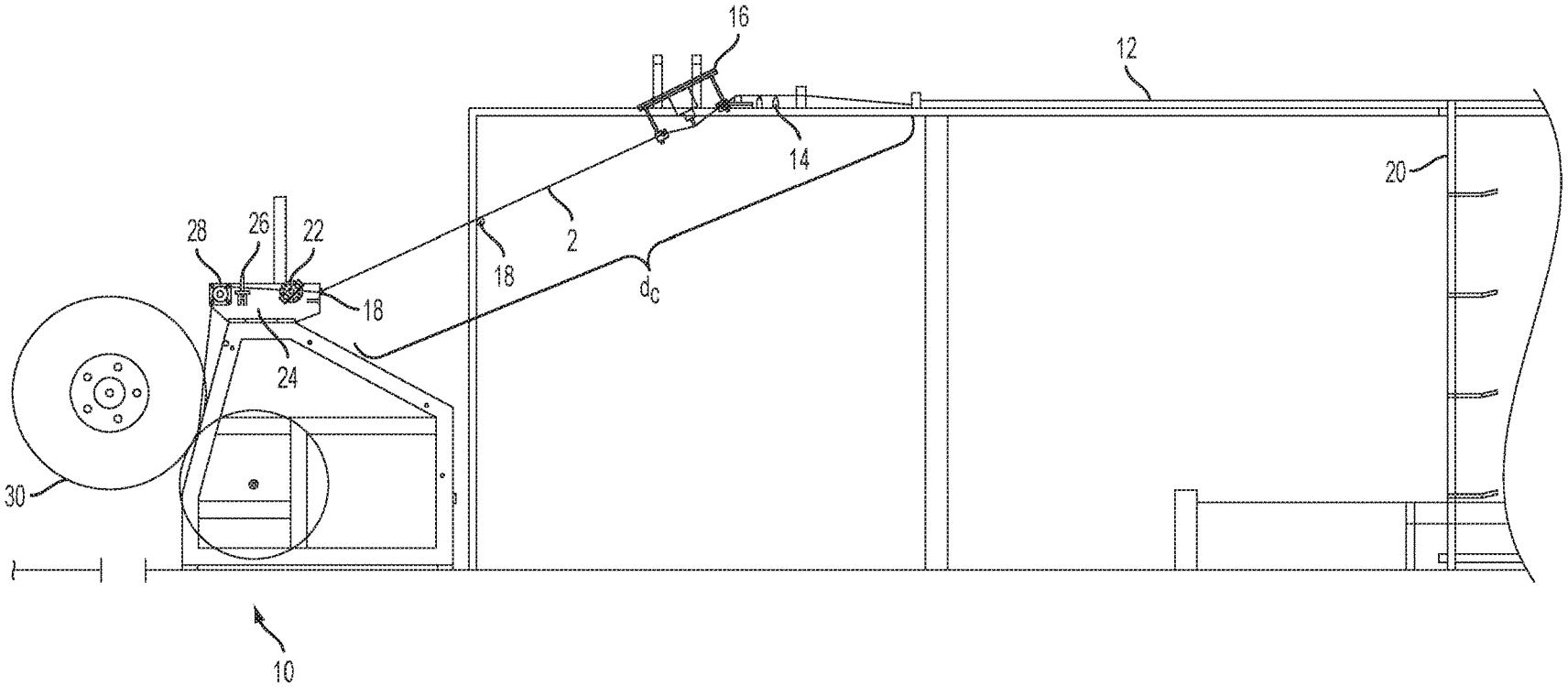
FIG. 1 PRIOR ART
FIG. 1 is a side elevational view of a conventional prior art warping system.

Referring now to FIG. 1, a conventional system for supplying yarn 2 to a warper 10 can include a plurality of tubes 12, a plurality of drop wires 14, a plurality of tight end detectors 16, and a plurality of yarn guides 18. As can be appreciated, with conventional systems, there is a tube, a drop wire, a tight end detector, and at least one guide for each yarn end. For example, if there are 200 yarn ends to be supplied to the warper, there can be 200 tubes, 200 drop wires, 200 tight end detectors, and at least 200 guides.

Still with reference to FIG. 1, the plurality of tubes 12 of a conventional warper supply system can extend from a creel 20 to a predetermined conventional tube distance ($d_c$) from the warper. This predetermined distance can be spaced from the warper 10 to provide room for the yarn 2 to be threaded through the drop wires 14 and the tight end detectors 16. The guides can align the yarn leaving the tight end detectors with an S-bar roller 22 mounted to a top 24 of the warper 10. An expansion comb 26 can be positioned between the S-bar roller and a second roller 28.

In use, each yarn end 2 of a conventional system for supplying yarn to a warper 10 can be threaded from a package on the creel 20 through a tube 12. At the end of the tube, the yarn is threaded through a drop wire 14 and a tight end detector 16. The yarn is then threaded through the at least one guide 18 and around the S-bar roller 22. The expansion comb 26 positions each yarn end 2 as desired relative to each other and a beam 30 in the warper. For example, the expansion comb can evenly space each yarn end relative to the width of the beam 30. After being threaded through the expansion comb, the yarn travels around at least a portion of the second roller 28 before being attached to the beam.

As previously discussed, threading of yarn 2 in a conventional system for supplying yarn to a warper 10 can greatly increase tension on the yarn, and further, the tension can vary from yarn end to end. When a conventional system is viewed from the side as in FIG. 1, it can be seen that yarn is redirected at least by the tight end detector 16, the yarn guide 18, the S-bar roller 22 and the second roller 28. Each of these redirections increases tension in the yarn. Also, because the expansion comb 26 is located very near the yarn guide 18, (i.e., literally approximately 14 inches on conventional systems) tension in the yarn as it is expanded across the short space between the expansion comb and the yarn guide can be excessively high. That is, because the yarn is required to expand over a relatively short distance, a significant amount of force (i.e., tension) can be required to pull the yarn through the relatively sharp angles of this conventional arrangement. Further, tension in yarn ends 2 that are necessarily subject to the greatest expansion by the expansion comb/yarn guide combination are typically higher than the tension in yarn that is redirected a smaller amount. For example, yarn ends 2 near the peripheral edges of the expansion comb/yarn guide combination are expanded further than yarn ends near the center of the expansion comb with resultingly significantly higher tension being applied to the yarn ends 2 near the peripheral edges of the expansion comb than the tension applied to the yarn ends near the center of the expansion comb. The yarn ends near the peripheral edges must therefore travel through a yarn path having shaper angles than yarn ends near the center of the expansion comb 26. Thus, tension in the ends near the peripheral edges can be significantly higher than ends 2 near the center of the expansion comb.

Figure 2:
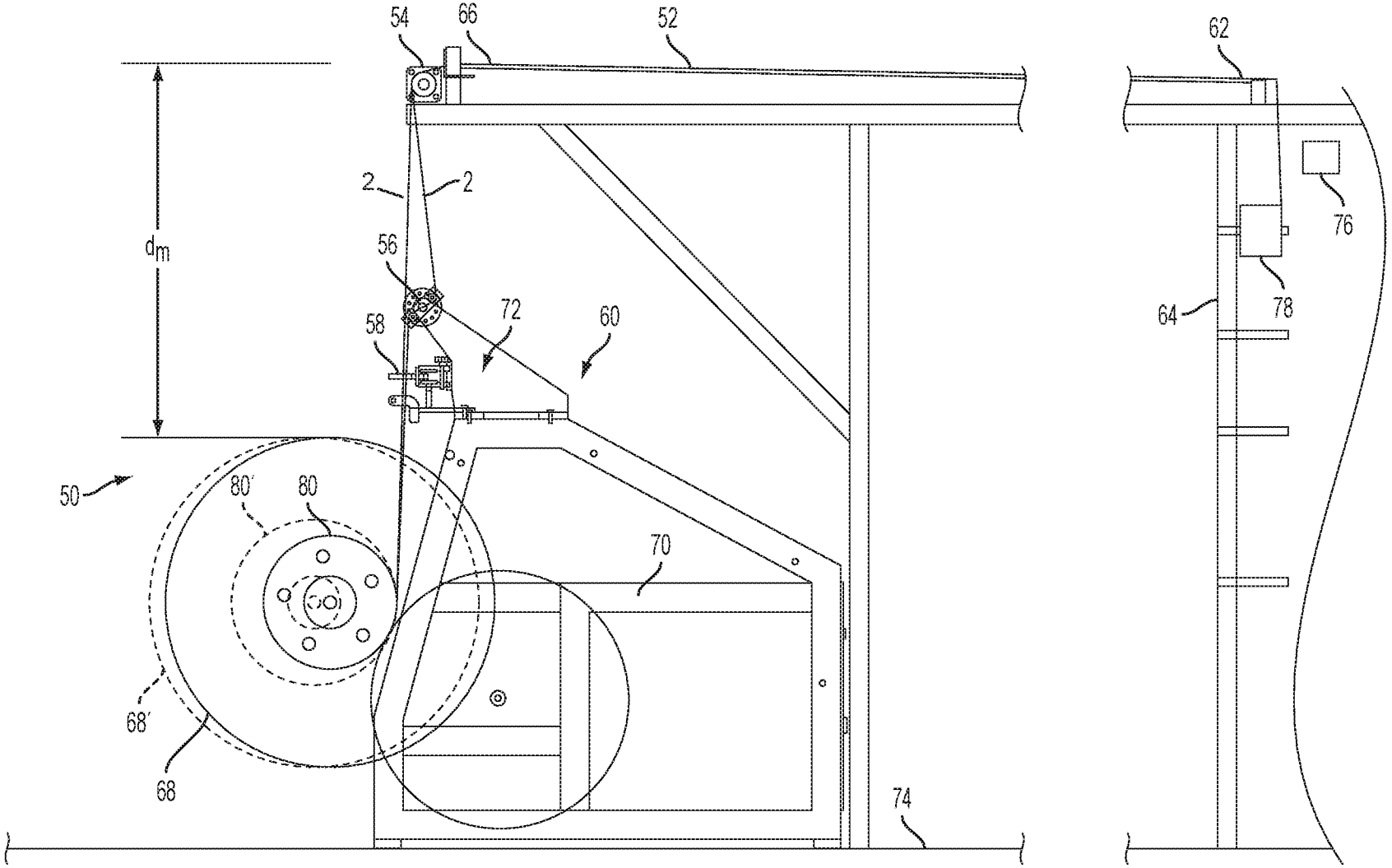
FIG. 2 is a side elevational view of an exemplary warping system as described herein, according to one aspect. The broken lines show yarn being wound onto the beam and the outer diameter of the beam increasing as a result of the winding up and the warper concurrently articulating the beam away from the roller so that the angle formed by yarn positioned between the roller and the warper remains substantially the same.
Figure 3:
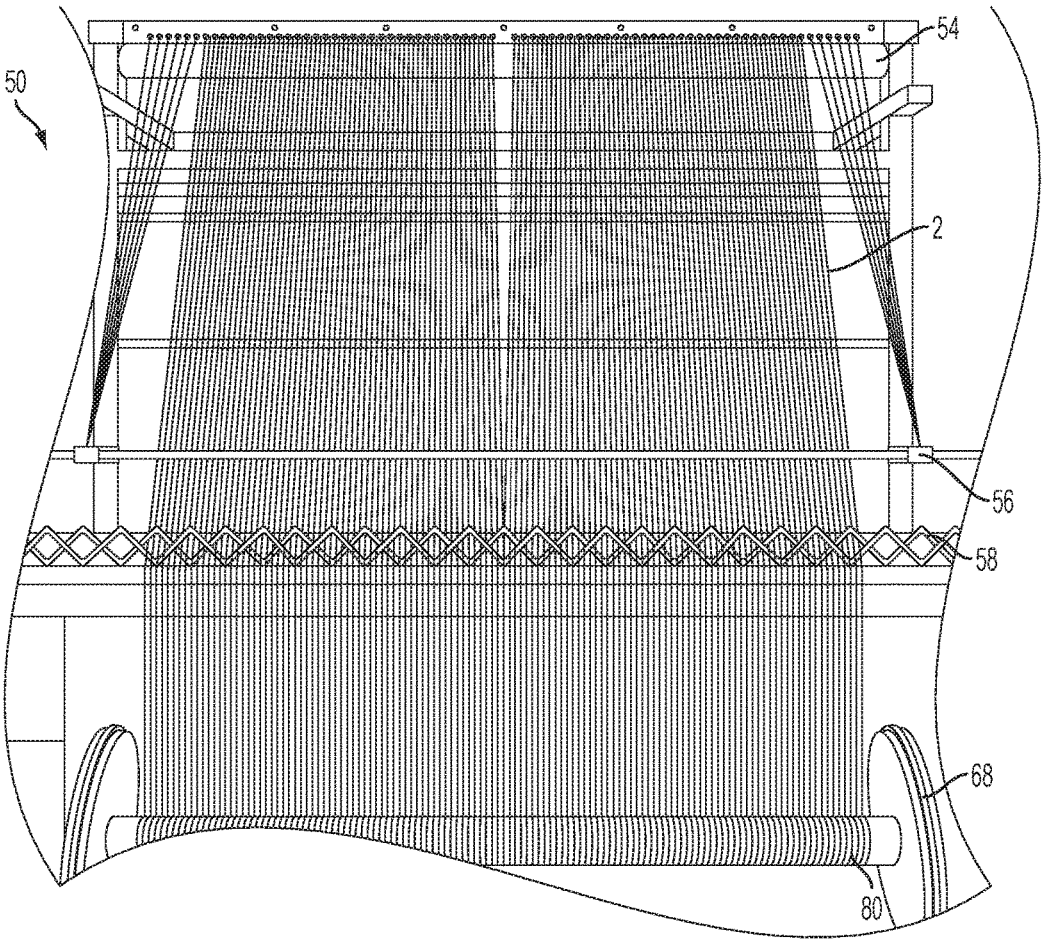
FIG. 3 is a front elevational view of the warping system of FIG. 2.

In one aspect, and as shown in FIGS. 2-3, a system and method for regulating tension in warping 50 is provided. In this aspect, the system can minimize the number of contact points yarn traveling through the system will contact. In another aspect, the system can comprise at least one of a plurality of tubes 52, a roller 54, an S-bar roller 56, an expansion comb 58 and a warper 60.

In one aspect, each tube 52 of the plurality of tubes can have a lumen extending therethrough that is configured or otherwise sized and shaped to allow for the free passage of one yarn. In operation, each yarn end 2 being fed to the warper 60 can pass through one tube. In another aspect, each tube 52 of the plurality of tubes can have a first tube end 62 positioned adjacent to a creel 64 and a second tube end 66 positioned a predetermined tube distance ($d_m$) from the beam 68, according to one aspect. Though not illustrated in FIG. 2, optionally, the predetermined tube distance can be measured from the second tube end to the warper 60. In another aspect, the predetermined tube distance ($d_m$) can be less than the predetermined conventional tube distance ($d_c$), which is approximately between about 8 to 12 feet and in some configurations, about 10 feet. In still another aspect, the second tube end can be positioned above at least a portion of the warper 60 and/or a beam 68 cradled in the warper. In various aspects, each tube 52 of the plurality of tubes can have a tube length that is less than, substantially equal to, or greater than the length of a conventional tube 12.

In one aspect, the roller 54 can be a conventional roller configured to carry yarn and/or modify the direction in which yarn travels as it is pulled through the system 50. In another aspect, the roller can be positioned adjacent the second tube end 66. In still another aspect, the roller can be positioned above at least a portion of the warper 60 and/or a beam 68 cradled in the warper. As illustrated in FIG. 2, when in use, yarn can wrap around at least a portion of the roller 54 a predetermined amount to direct the yarn toward the warper. For example, yarn can wrap around the roller about 90°, though it is contemplated that the yarn can wrap around the roller 54 less than about 45°, about 45°, about 50°, about 55°, about 60°, about 65°, about 70°, about 75°, about 80°, about 85°, about 90°, about 95°, about 100°, about 105°, about 110°, about 115°, about 120°, about 125°, about 130°, about 135°, or more than or about 135°. In another aspect, the roller can be positioned so that a yarn plane 3 extends from a circumferential edge of the roller to an outer diameter 80 of wound yarn on the beam 68. As will be described more fully below, yarn ends extending from the roller to the outer diameter of wound yarn on the beam can be substantially positioned in the yarn plane 3.

The S-bar roller 56 can be a conventional S-bar roller configured to selectively adjust the tension on yarn 2 contacting the S-bar roller. In one aspect, the S-bar roller can be adjusted, either manually by a user or automatically by a tension monitoring system, to impart a desired amount of tension on the yarn. For example, to lower the tension, the S-bar roller can be adjusted to reduce the amount of contact between the yarn and the roller. Alternatively, the S-bar roller 56 can be adjusted to increase the wrap of yarn on the S-bar roller, thereby increasing the amount of tension applied to the yarn.

In one aspect, the expansion comb 58 can be a conventional expansion comb configured to position each yarn end 2 as desired relative to the other yarn ends and/or the width of the beam 68. For example and without limitation, the expansion comb can be configured to evenly space each yarn end relative to the other yarn ends. In another aspect, the expansion comb can be configured to redirect yarn axially relative to the beam so that an even layer of yarn can be applied to the beam as it rotates in the warper 60.

According to one aspect, the warper 60 can comprise a beam cradle 70 conventionally configured for mounting a beam 68 to the warper. In one aspect, it is contemplated that the warper can be a conventional warper. In one aspect, the warper can further comprise a means for rotating a beam positioned in the beam cradle, such as for example, any conventional combination of motors, gears and the like. In another aspect, the warper further comprises a warper top 72. In this aspect, the warper top can be a support system attached to the warper and configured for mounting at least one of the S-bar roller 56 and the expansion comb 58 thereto.

Figure 4:
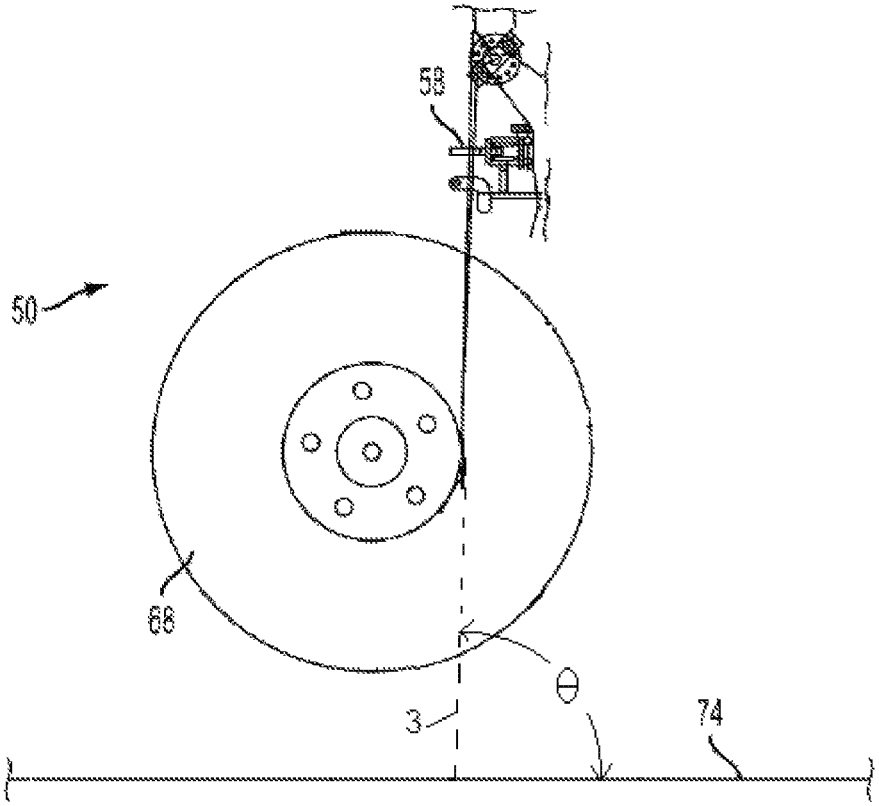
FIG. 4 is an isolated side elevational view of the warping system in FIG. 2, depicting the angle formed between a horizontal surface supporting the warper and a yarn plane coinciding with the yarn extending from the roller to the warper.

In one aspect, the warper 60 further comprises a means for maintaining a substantially constant angle formed by yarn extending between the roller 54 and the beam 68 relative to a surface 74 on which the warper is positioned. In another aspect, with reference to FIG. 4, the warper further comprises a means for maintaining a substantially constant angle Θ formed by the yarn plane 3 and the horizontal surface on which the warper is positioned. For example, as yarn is wound onto the beam and the outer diameter of wound yarn on the beam increases, the warper can articulate the beam away from the roller 54 so that the angle Θ formed by yarn positioned between the roller and the warper remains substantially the same. With reference to FIG. 2 and FIG. 4, it can be appreciated that as yarn 2 is wound onto the beam, the beam 68 can move away from the roller (for example, towards the left in FIG. 2) in order to maintain a substantially constant angle Θ formed by yarn positioned between the roller and the beam.

Optionally, in one aspect, the system 50 can further comprise at least one end-out detection device 76 positioned on the creel. For example and without limitation, an end-out detection device can be positioned adjacent each yarn package 78 positioned on the creel 64. In this aspect, the end-out detection device can be a non-contact sensor, or a low or no friction detection sensor such as, for example and without limitation, an optical or a piezoelectric sensor. In another aspect, the end-out detection device 76 can be a low-contact yarn break sensor (i.e., a sensor in which there can be contact between the sensor and yarn 2 without adding a measurable amount of tension to the yarn) such as those produced by Eltex U.S., Inc., and the like. In still another aspect, the end-out detection device 76 can be a "touch-less" yarn break sensor such as those produced by BTSR, Inc. of Italy, and the like.

To assemble the system and method for regulating tension in warping 50 of the current application, the first tube end 62 of each tube 52 of the plurality of tubes can be positioned adjacent the creel 64 and the second tube end 66 can be positioned above at least a portion of the warper 60 and/or a beam positioned in the warper. In one aspect, at least a portion of each tube can be substantially parallel to the surface 74 on which the warper sits. In another aspect, at least a portion of each tube 52 can be substantially parallel to other tubes of the plurality of tubes.

The roller 54 can be positioned adjacent the second tube end 66 of the plurality of tubes 52, and above at least a portion of the warper 60. In one aspect, the roller can be configured to redirect yarn 2 exiting the tubes towards the warper. In another aspect, the roller can be positioned so that a yarn plane 3 extends from a circumferential edge of the roller to an outer diameter 80 of wound yarn on the beam 68. In this aspect, the yarn ends extending from the roller to the outer diameter of wound yarn on the beam can be substantially positioned in the yarn plane 3. In still another aspect, the roller can be positioned such that yarn redirected towards the warper (i.e., in the yarn plane 3) is redirected at an angle of about 90° relative to the surface 74 on which the warper sits. In still another aspect, the roller can be positioned such that yarn redirected towards the warper is redirected at an angle of about 75°, about 80°, about 85°, about 95°, about 100°, or about 105° relative to the surface on which the warper sits. In another aspect, the roller 54 can be positioned so that yarn redirected towards the warper 60 contacts the beam 68 cradled in the warper at about the three o'clock position on the beam when viewed from the side as in FIG. 2.

In one aspect, the S-bar roller 56 and/or the expansion comb 58 can be positioned between the roller 54 and the beam 68 so that at least a portion of the yarn 2 extending from the roller to the beam is substantially linear, when viewed from the side as in FIG. 2. In another aspect, the S-bar roller and/or the expansion comb can be positioned between the roller and the beam so the yarn extending from the roller 54 to the beam 68 is substantially positioned in the yarn plane 3. For example, at least a portion of the yarn extending from the roller to the beam can contact the S-bar roller and/or the expansion comb without being substantially redirected by the S-bar roller 56 and/or the expansion comb 58. That is, the S-bar roller can contact at least a portion of the yarn 2, thereby applying tension to the contacted yarn, without substantially redirecting the yarn in the yarn plane 3 from the roller 54 to the beam.

Similarly, at least a portion of the yarn 2 extending from the roller 54 to the beam 68 can contact the expansion comb 58. As one skilled in the art will appreciate and upon viewing of FIGS. 2 and 3, it can be seen that the expansion comb 58 is spaced a large distance from the roller 54 so that minimal tension is added to the respective yarns during the expansion of the yarn from the roller to the expansion comb. It is contemplated that the expansion distance between the yarn exiting the roller 54 and entrance into the expansion comb 58 can be between about 2 to 6 feet, optionally between about 2.5 to 5 feet, and preferably about 3 feet. When compared to the conventional system described above, one skilled in the art will appreciate that the angles/force imparted on the yarn is much less in the system described herein. In comparison, the yarn ends near the peripheral edges of the present system will therefore travel through a yarn path having much smaller acute angles than comparable yarn on the conventional system described above.

In one aspect, the expansion comb 58 can redirect yarn 2 axially relative to the beam 68 so that an even layer of yarn can be applied to the beam as it rotates in the warper 60. However, the expansion comb can be positioned so that the yarn is not redirected when viewed in a side elevational view as illustrated in FIG. 2. Thus, the expansion comb can redirect the yarn axially relative to the beam 68 without urging the yarn out of the yarn plane 3. In another aspect, the expansion comb 58 can be positioned between the roller 54 and the beam a predetermined distance from the roller. For example and without limitation, the expansion comb can be positioned substantially equidistance from the roller and the outer diameter 80 of wound yarn on the beam 68. In still another aspect, the expansion comb can be positioned closer to the roller than the outer diameter of wound yarn on the beam. Alternatively, the expansion comb 58 can be positioned closer to the outer diameter of wound yarn on the beam than the roller.

In one aspect, the expansion comb 58 can be positioned relative to the roller 54 and the beam 68 beam so that yarn 2 can be gradually expanded by the expansion comb. In this aspect, the yarn can be expanded over a greater distance than the expansion distance of conventional warping systems. Thus, the angles through which the yarn is redirected in the current warping system 50 are more gradual angles than those of conventional systems, thereby reducing tension imparted to the yarn. For example, when viewed in a front elevation view as illustrated in FIG. 3, the yarn 2 can appear to be almost linear. This is because the positioning of the expansion comb 58 relative to the roller 54 and the beam 68 allows for a gradual expansion of the yarn, greatly reducing yarn tension compared to conventional warping systems. Further, in one aspect, there are no yarn contact points between the expansion comb and the beam. After the yarn has been expanded to its predetermined position relative to the width of the beam, the yarn is wound onto the beam without contacting any other devices. It is contemplated, however, that there can be one, two, or more than two contact points between the expansion comb and the beam.

In use, each yarn end 2 to be wound onto the beam 68 can be threaded from a package 78 on the creel 64 through a tube 52 of the plurality of tubes (the yarn can be inserted into the first tube end 62 of a tube positioned near the creel, and exit the second tube end 66 of the tube above a portion of the warper 60). Each yarn can be threaded around at least a portion of the roller 54, through the expansion comb 58 and to the beam 68. Optionally, the yarn can be threaded around at least a portion of the S-bar roller 56, prior to the expansion comb. In one aspect, after exiting the second tube end of the tube, yarn can contact the warping system 50 at only two other contact points, the roller the expansion comb.

Because all locations on the roller 54, the expansion comb 58 and the S-bar roller 56 are easily accessible from the front of the warper 60 (as illustrated in FIG. 3), when yarn is threaded as described above, a user of the warping system 50 can thread the yarn ends 2 entirely from the roller to the beam from the front of the machine. Thus, threading time can be reduced when compared to conventional systems because the user does not have to thread from both sides.

After the desired number of yarn ends 2 have been threaded through the warping system 50 as described herein, the beam 68 can rotate, pulling yarn off the packages 78 and onto the beam 68.

Tension in the yarn 2 of the current system 50 can be greatly reduced for several reasons when compared to conventional warping systems because: 1) there is a substantially linear direction of yarn from the roller 54 to the beam 68 when viewed from the side (because it is substantially a "straight shot" and the yarn does not have to make several turns to reach the beam); 2) several conventional contact points, such as for example and without limitation, guides 18, drop wires 14, and tight end detectors 16 have been eliminated in the current system; and 3) yarn is expanded by the expansion comb 58 over a greater distance than present in conventional warping systems, thereby reducing the tension required to pull the yarn through the expansion comb. For example, tension in at least a portion of the yarn ends 2 of the current system 50 can be reduced by about 90%, about 80%, about 75%, about 70%, about 60%, about 50%, about 40%, about 30%, about 25%, about 20% or about 10% when compared to conventional warping systems.

If a yarn end 2 breaks, it will likely break near the creel 64 because this is the location where yarn tension will be highest. However, the end-out detection device 76 positioned near the creel can detect the broken end and stop the warper 60 early, reducing time required to repair the yarn end compared to conventional systems. Further, because the end-out detection device can be a no or low-friction device, it can detect broken ends without increasing tension in the yarn.

Because the yarn 2 wound onto a beam 68 using the warping system 50 of the present application can be wound onto the beam at a lower and/or a regulated tension when compared to conventional systems, the beam of yarn can be used more easily to manufacture a textile product. Moreover, processing speed of the warper can be increased without raising tension of the yarn to a level of tension in current warping systems. For example, as can be appreciated, raising warper speed increases tension in the yarn. However, because the warping system 50 of the present application operates with a lower yarn tension (at a given speed) than conventional warpers, the present warping system can operate at a much higher speed than conventional warpers while maintaining yarn tension at or below conventional levels.

For example, using a conventional system as previously described above, a 1354/2 ply yarn that is wound at 450 yards per minute will have a tension that will measure at about 150 grams. In contrast, yarn processed in the system described herein will have a measured tension that is much less. For example, for a 1354/2 ply yarn that is wound at 550 yards per minute can have a tension that will measure at less than 75 grams. Thus, even when run at a higher processing speed, the present system can provide a yarn with significantly less applied tension, which results in a yarn having much better manufacturing usability. It is contemplated that the present system can be run at speeds in excess of 500-550 yards per minute with still significant reduction in applied tension when compared to) yarn produced in conventional systems being operated a conventional speeds (i.e., about 450 yards per minute). One skilled in the art will appreciate that conventional machines do not typically operate at higher speeds as the applied tension to the yarns reaches a point of manufacturing non-usability. Thus, the present system provides a means for producing a faster product winding throughput while simultaneously producing a much more usable yarn that is wound on the beam for subsequent manufacturing operations.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is therefore understood that the invention is not limited to the specific embodiments disclosed herein, and that many modifications and other embodiments of the invention are intended to be included within the scope of the invention. Moreover, although specific terms are employed herein, they are used only in a generic and descriptive sense, and not for the purposes of limiting the described invention.

What is claimed is:

1. A warping system in proximity to a yarn creel that supplies yarn thereto, the warping system comprising:

a beam for winding yarn thereon;

a warper configured to support and rotate the beam as yarn is wound onto the beam;

a warper top attached to the warper and positioned vertically above the warper;

a roller that is vertically above and vertically spaced from the warper top, the warper, and the beam, wherein the roller receives yarn directly from the yarn creel and redirects the yarn towards the beam;

an expansion comb positioned between the roller and the warper along a vertical axis, wherein the expansion comb is mounted to the warper top, wherein at least a portion of the yarn extends between the roller and the beam and contacts the expansion comb while remaining substantially within a yarn plane, wherein the yarn plane is oriented at a substantially constant angle relative to a horizontal surface on which the warper is positioned, and wherein the warper is further configured to articulate the beam relative to the roller to maintain the substantially constant angle between the yarn plane and the horizontal surface as the wound yarn on the outer diameter of the beam increases.

2. The warping system of claim 1, further comprising a plurality of tubes, wherein a first tube end of each tube of the plurality of tubes is positioned adjacent to the yarn creel and a second tube end of each tube of the plurality of tubes is positioned above the warper, the warper top, and the expansion comb, and wherein each tube has a lumen extending therethrough that is sized and shaped to allow for the free passage of one yarn.

3. The warping system of claim 2, wherein the second end of each tube is positioned adjacent the roller.

4. The warping system of claim 1, wherein an expansion distance between the roller and the expansion comb, measured along the vertical axis, ranges from about 2 to about 6 feet.

5. The warping system of claim 1, wherein the substantially constant angle between the yarn plane and the horizontal surface is about 90 degrees.

6. The warping system of claim 1, further comprising an end-out detection device positioned proximate the yarn creel.

7. The warping system of claim 6, wherein the end-out detection device comprises a non-contact sensor.

8. The warping system of claim 6, wherein the end-out detection device comprises a low-contact sensor.

9. The warping system of claim 1, wherein the roller consists of a single roller.

10. A warping system in proximity to a yarn creel that supplies yarn thereto, the warping system comprising:

a beam for winding yarn thereon;

a warper configured to support and rotate the beam as yarn is wound onto the beam; a warper top attached to the warper and positioned vertically above the warper a roller that is vertically above and vertically spaced from the warper top, the warper and the beam, wherein the roller receives yarn directly from the yarn creel and redirects the yarn towards the beam;

an expansion comb positioned between the roller and the warper along a vertical axis, wherein the expansion comb is mounted to the warper top; and a plurality of tubes, wherein a first tube end of each tube of the plurality of tubes is positioned adjacent to the yarn creel and a second tube end of each tube of the plurality of tubes is positioned adjacent to the roller, and wherein each tube has a lumen extending therethrough that is sized and shaped to allow for the free passage of one yarn, wherein at least a portion of the yarn extends between the roller and the beam and contacts the expansion comb while remaining substantially within a yarn plane, wherein the yarn plane is oriented at a substantially constant angle relative to a horizontal surface on which the warper is positioned, and wherein the warper is further configured to articulate the beam relative to the roller to maintain the substantially constant angle between the yarn plane and the horizontal surface as the wound yarn on the outer diameter of the beam increases.

11. The warping system of claim 10, wherein an expansion distance between the roller and the expansion comb, measured along the vertical axis, ranges from about 2 to about 6 feet.

12. The warping system of claim 10, wherein the roller consists of a single roller.

13. The warping system of claim 10, wherein the substantially constant angle between the yarn plane and the horizontal surface is about 90 degrees.

14. A warping system in proximity to a yarn creel that supplies yarn thereto, the warping system comprising:

a plurality of yarns;

a beam for winding the yarns thereon;

a warper configured to support and rotate the beam as the yarns are wound onto the beam; a warper top attached to the warper and positioned vertically above the warper a roller that is vertically above and vertically spaced from the warper top, the warper and the beam, wherein the roller receives yarn directly from the yarn creel and redirects the yarn towards the beam;

an expansion comb positioned between the roller and the warper along a vertical axis wherein the expansion comb is mounted to the warper top, the expansion comb configured to position each yarn in a predetermined position relative to other yarns extending from the roller to the beam, wherein at least a portion of the yarns extends between the roller and the beam and contacts the expansion comb while remaining substantially within a yarn plane, wherein the yarn plane is oriented at a substantially constant angle relative to a horizontal surface on which the warper is positioned, and wherein the warper is further configured to articulate the beam relative to the roller to maintain the substantially constant angle between the yarn plane and the horizontal surface as the wound yarn on the outer diameter of the beam increases.

15. The warping system of claim 14, wherein the roller consists of a single roller.

16. The warping system of claim 14, wherein the substantially constant angle is about 90 degrees.

17. The warping system of claim 14, wherein an expansion distance between the roller and the expansion comb, measured along the vertical axis, ranges from about 2 to about 6 feet.

* * * * *